US007783069B1

(12) United States Patent
Miller et al.

(10) Patent No.: US 7,783,069 B1
(45) Date of Patent: Aug. 24, 2010

(54) ERGONOMIC PERFORMANCE CHAMBER

(76) Inventors: John William Miller, 4361 E. 6th St., Long Beach, CA (US) 90814; William John Miller, 4361 E. 6th St., Long Beach, CA (US) 90814

( * ) Notice: Subject to any disclaimer, the term of this patent is extended or adjusted under 35 U.S.C. 154(b) by 471 days.

(21) Appl. No.: 11/746,569

(22) Filed: May 9, 2007

(51) Int. Cl.
*H04R 1/02* (2006.01)

(52) U.S. Cl. ..... 381/354; 381/345; 381/359; 381/360; 381/366

(58) Field of Classification Search ..... 381/91, 381/345, 353–354, 359, 360, 71.7, 361–368; 181/151, 198, 175, 284–295, 153
See application file for complete search history.

(56) References Cited

U.S. PATENT DOCUMENTS

| | | | | |
|---|---|---|---|---|
| 2,263,408 | A * | 11/1941 | Lakhovsky | 181/242 |
| 2,566,975 | A * | 9/1951 | Beranek | 181/242 |
| 3,244,816 | A * | 4/1966 | Karns | 434/156 |
| 3,895,188 | A * | 7/1975 | Ingraham | 381/160 |
| 4,967,874 | A * | 11/1990 | Scalli | 181/158 |
| 5,123,874 | A | 6/1992 | White | |
| 6,584,736 | B2 | 7/2003 | Szymanski | |
| 2008/0302599 | A1 * | 12/2008 | Zou | 181/290 |

FOREIGN PATENT DOCUMENTS

EP 000637188 A1 * 7/1994

OTHER PUBLICATIONS

Mike Rehmus of ByVideo published his homemade approach to acoustic problems on the Internet. Web site: http://www.byvideo.com Photo of apparatus: http://www.byvideo.com/new_page_2.htm Publication date unknown.

Gretch-Ken industries published an analogous portable device for sale Web site: http://www.soundsuckers.com/current.htm Photo of apparatus: http://www.soundsuckers.com/current.htm#current (scroll down to view) Publication date unknown.

* cited by examiner

*Primary Examiner*—Curtis Kuntz
*Assistant Examiner*—Ryan Robinson

(57) ABSTRACT

The ergonomic performance chamber 50 improves audio production efficiency for recording vocals or other sound sources with a microphone. The basic embodiment features an openable, lightweight, easily portative, molded flexible plastic, elemental structure 20, that surrounds only the microphone, and includes, a top 42 portion, a bottom 43 portion, an outer surface 21, a plurality of abutting surfaces 22, an audio source opening collar 23, an audio source opening 24, a microphone attachment collar 25, a microphone opening 26, an acoustically controlled air space 27, an inner chamber surface 28, a chamber body 29, and a plurality of insert slots 31. Acoustic inserts 30 are used to modify the quality of sound in the acoustically controlled air space 27. A desktop support 39 is used for desktop installation. The present invention combines acoustic control and ergonomics to facilitate production workflow and meet the needs for a wide variety of performers.

10 Claims, 9 Drawing Sheets

FIG. 11
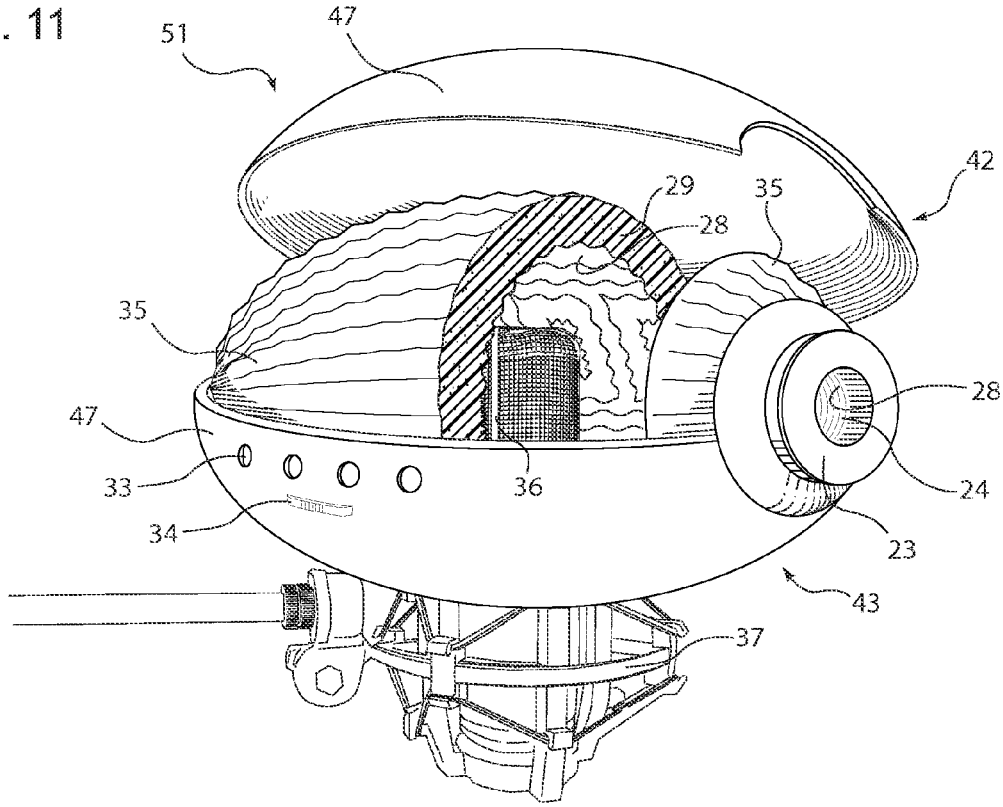
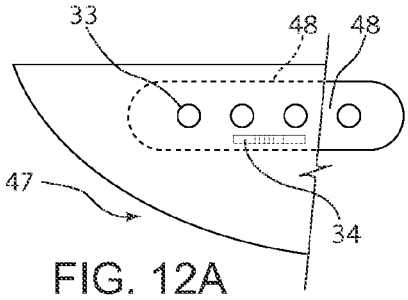
FIG. 12A
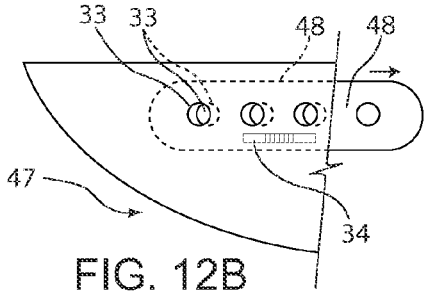
FIG. 12B
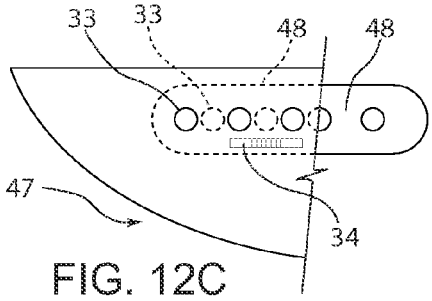
FIG. 12C

ERGONOMIC PERFORMANCE CHAMBER

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

Field of Invention

The present invention relates to anechoic chambers and sound isolation booths that alter, reflect or enhance sound energy before it reaches a microphone without the use of electronics and, more particularly, to conveniently portative anechoic chambers that reflect ambient noise and reduce inner chamber reverberation while performing or recording with a microphone.

Description of the Problem

It is standard practice to control the acoustic environment of spaces wherein sound quality is important, such as theaters, stadiums, studios, or other rooms. Proper architectural design of the building is critical for acoustic control, as is subsequent sound wave analysis of the room or space. Performing or recording with a microphone further compounds some aspects of room noise by amplifying unwanted peripheral sounds that otherwise may have gone unnoticed. This sort of unwanted noise includes breath pops, inadvertent knocking of the microphone, and equipment feedback. Efforts to mitigate all of these problems are attempted in a variety of ways.

The advent of affordable, good quality, audio and video equipment has also increased the demand and expectation for quality results. However, the necessary studio-like environment is economically prohibitive, difficult to implement, and aesthetically awkward in all but those rooms dedicated to the purpose of recording. Controlling ambient noise and the quality of the acoustic environment is difficult or impractical in many, if not most, common situations using a microphone.

Hence, most performances and recordings are created in less than optimal rooms, offices, and garages that were not designed with acoustic quality in mind. As a result, a substantial amount of time and effort is spent either repeating the performance, or editing to eliminate unwanted noise and improve the quality of the recorded sound. Sources of unwanted noise include oscillating fans, ventilation ducts, computer noise, amplifier noise, street noise, as well as noise from appliances such as copy machines and washing machines. Unsatisfactory room acoustics may be compounded by performer fatigue and stress resulting from poorly designed acoustical devices. Performers who use such devices not only risk fatigue, but loss of efficiency.

Although most instrumental parts and effects may be fed directly to the recording device, most vocals are performed in an area or room using a microphone. Microphones are subject to wind noise, ambient noise, and the effects of reflected sound. There is a need for a device that is small, lightweight, affordable, easy to attach, transport, store, ergonomic and effective. This combination of features would offer new utility and increased productivity for those who may otherwise forgo acoustic control of their recording space, as well as providing flexibility for recording professionals.

Prior Art

Since the advent of microphones, shielding the vibrating element has been important to reduce unwanted wind noise. The microphone's housing and apparatus also serve to protect its sensitive electronics from shock and damage, but more must be done to capture the quality of sound a performer desires and further reduce ambient noise.

Acoustically refined architecture was evidenced in the ancient Greek outdoor amphitheaters, which were cleverly designed to enhance sounds to reach larger audiences. In the modern era, many patents have been issued for ideas that deal with enhancing and controlling sound energy and quality. These ideas and products offer a wide range of solutions, and must continue to evolve with technology in general.

One way to manage noise and control the acoustic environment is a sound booth such as White's Knock-Down Sound Attenuating System (U.S. Pat. No. 5,123,874 June/1992). It was designed to be a portable apparatus in which the musician played or sang while completely housed within the confines of the enclosure.

Auralex, a company well known for acoustic panels, patented a solitary foam acoustic panel that mounts below the microphone to the stand (U.S. Pat. No. 6,584,736 July/2003). Auralex considered this idea an alternative to foam panels traditionally mounted throughout the room for use in home studios and the like.

Another approach is Scalli's Microphone Baffle Apparatus (U.S. Pat. No. 4,967,874 November/1990), which is a smaller, flexible, and shapeable foam disc that slips over the handle of a microphone to create a sound absorbing surface near the microphone, and purported to act as an ambient sound blocking attachment.

Mike Rehmus of ByVideo published his homemade approach to acoustic problems on the Internet (http://www.byvideo.com/new_page_2.htm). He describes a box, completely open on one side, made from a plastic storage bin and plywood fastened atop a speaker stand. He glued acoustic foam to the interior surfaces and suspended the microphone within the box.

Also published on the Internet is a portable device sold by Gretch-Ken Industries, Inc. in Lakeview, Oreg. (http://www.soundsuckers.com/current.htm). This box-shaped device installs around the microphone and is supported by a desktop surface. It has three sides and a top. The bottom is formed by the desk surface, the front side being generally open, or covered with a fabric shroud.

Many thoughtful devices, from a variety of fields, have been patented to help mitigate the problems of containing sound, reflecting sound, or altering its quality. The need to improve the acoustics in areas and rooms that were not designed for such work is more important than ever. The pace of new technology development over the last fifteen years has been remarkable. Microphones are now widely used for a broad range of applications such as corporate video voiceovers, computer presentations, computer web-based applications, podcasts, music class practice, and home studio recording. Despite a revolution in the way all media is created, edited, and published, and in the affordability of the equipment, the prior art does not address a broad, convenient, and efficient approach to acoustic control.

Disadvantages of the Prior Art

The best recording environments are in buildings and rooms designed with all aspects of acoustic control in mind. The structure may be specially built from the foundation up to isolate vibration. Doors, windows, floors and all surfaces are carefully considered, as are equipment and furniture, to provide a particular acoustic environment. Foam panels are commonly added to tune a room's reflectivity for a desired quality of sound. The cost to own or even rent time in such a space is expensive and inconvenient for the vast majority of people. In many areas of the country, it isn't possible to find such a studio since there must be enough demand to support these costly facilities.

One alternative approach is the sound booth, which may be built or purchased. These booths attempt to replicate a studio-like environment and are built to minimize sound transmission. They are large, heavy and expensive. White's Knock-Down Sound Attenuating System (U.S. Pat. No. 5,123,874 June/1992) was considered transportable, but a quick review of the drawings reveals that it was a significant undertaking to dismantle, move and reassemble. Other drawbacks to this booth, and sound booths in general, include the constrained, uncomfortable environment, ventilation that is either non-existent or expensive to implement, and difficulty working with others since the performer is essentially in another room.

Foam acoustic panels are a common method of refining sound quality in a studio or room. First, sound reflectivity should be metered and analyzed. Subsequently, specialized panels (or blocks) of foam are installed on critical wall surfaces, in room corners, and near drum kits, etc. Each panel has a purpose in creating the proper sound dynamic for that room or space. These acoustic panels are often large, expensive, and difficult to install and adjust properly. It is not practical to permanently install such panels in a room or office used for purposes other than recording. Ambient noise is not appreciably diminished, and sound-proofing measures must also be implemented.

Auralex recognized the need for another solution and developed a specialized acoustic panel (U.S. Pat. No. 6,584,736 July/2003) that mounts below the microphone on the stand. One object of the invention was that the panel lent itself to temporary installation in a room, while providing easy de-installation. However, it does not solve the problem of ambient noise nor appreciably control the quality of the sound entering the microphone. This single panel approach has little value as a viable solution to acoustic control in common circumstances.

Scalli's Microphone Baffle Apparatus (U.S. Pat. No. 4,967,874 November/1990) is a small, shapeable foam disc that slips over the handle of a microphone. The proximity of this baffle to the microphone, and the ability to bend the baffle, provides a modicum of sound absorption. But its acoustical effectiveness is limited at best, and claims of ambient noise reflection may be theoretically possible but difficult to measurably demonstrate.

Mike Rehmus and Gretch-Ken Industries (both published on the Internet) presented acoustic solutions that afford some value in effectiveness and relative portability. However, the ideas suggested by their designs are not fully considered in view of current needs, effectiveness and control.

Because of their size, weight, and difficulty to install, move or store, these devices are inconvenient, restrictive and awkward to use. They are cumbersome to reposition and inconvenient to mount or install on a table, desk, or dedicated stand. They are uncomfortable in most recording situations as these devices envelope the performer's head and shoulders and require a relatively static position or stance. Additionally, the performer's line of sight is obstructed, which greatly restricts vital visual communication and cues with other artists, engineers and assistants.

Furthermore, the static positioning encouraged by devices, such as those represented by Mike Rehmus and Gretch-Ken Industries, induces strain and fatigue. Location and/or apparatus requirements of these devices limit the ability to easily position and reposition the microphone, resulting in an uncomfortable and unnatural performance posture. In deadline critical circumstances or long sessions, ergonomics are important in terms of performer comfort and concomitant production efficiencies.

The portable prior art devices are not well suited for recording instruments such as guitars, woodwinds, or in any circumstance where positioning of the microphone is important or helpful to a performance. Even Scalli's device offers little advantage since it can not reduce ambient noise, offers little sound absorption, and can not help isolate one performance from another in the same room.

Additionally, the prior art utilizes large acoustic panels or baffles which are, in practice, fixed to room surfaces. This assumption in design limits the functional absorptive quality of these panels (and blocks) to the sonic characteristics predetermined by the method and manner of installation. A readily adaptable or configurable device would offer a broader solution for sound control.

Recording environments in specially designed buildings and rooms provide the best, but expensive, acoustic control. Sound booths that house the performer and instrument within its enclosure have also proven effective despite important noted limitations. But with regard to smaller, truly portable anechoic chambers for recording and performances, the prior art does not demonstrate a convincing appreciation for sound isolation. The prior art (such as Mike Rehmus and Gretch-Ken Industries) evidences much larger than necessary openings into the chamber, which allows entry of increased exterior ambient noise and diminishes the sound absorptive quality within the chamber. The anticipated benefits are significantly reduced since the microphone is not acoustically surrounded on all sides to the fullest practicable extent, The prior art does not solve several current needs. There is no small, lightweight, easily portative anechoic chamber. The existing chambers or enclosures, even if considered or called portable, are awkward to install, unwieldy to relocate, generally have large openings, or are completely open to noise on one side. No prior art provides for easily changeable or modifiable inner chamber acoustics to achieve or enhance a particular quality of sound. Nor does the prior art address the ergonomic problems these devices present in normal operation and as yet remain unsolved. A considered ergonomic construction would improve production efficiency, performer comfort, and safety during normal operation and use, and is long overdue. These ergonomic considerations include improved visual communication with colleagues while performing, the comfort of a natural performance posture to reduce fatigue, convenient installation and ease of positioning to improve workflow, as well as the convenience of transporting, storing or otherwise using these portative acoustic chambers, in the studio or field. Further, the prior art fails to provide an easily affordable solution for the consumer in terms of manufacturing and shipping costs. A device that offered a combination of all or most of the features currently lacking in the prior art would likely have synergistic advantages, providing a more efficient, comfortable and productive workflow when using portative anechoic chambers.

Advantages of the Ergonomic Performance Chamber

The specifications and drawings presented herein describe an ergonomic performance chamber that has improved on the advantages of the analogous devices in the prior art mentioned heretofore. The new ergonomic performance chamber has many novel advantages and features that were not fully anticipated, and utility that is not yet fully appreciated.

The basic embodiment, to be further described in detail, is one of the many possible constructions or variations of the ergonomic performance chamber. Other constructions or variations are also described as alternative embodiments, and still other features or advantages are described briefly as ramifications of the new invention. The advantages and improvements described in all of the embodiments, alternative embodiments, and ramifications are intended to broaden understanding of the general spirit and scope of the present invention, not to limit it. Accordingly the basic embodiment of the present invention includes, but is not limited by, the following advantages:

An advantage of the new ergonomic performance chamber is it surrounds only the microphone, rather than enclosing or surrounding additional recording equipment, computer equipment, and either all, or part of, the performer's body. Thus the ergonomic performance chamber may be constructed to be smaller, more lightweight, and much less cumbersome than analogous devices in the prior art.

Another advantage of the ergonomic performance chamber is the openings into the interior of the chamber are as few and small as practicable, one for an audio source input, and an opening and/or slit for microphone placement. Thus by minimizing exposure to ambient noise, the basic embodiment incorporates a better appreciation of acoustic isolation than evidenced in analogous devices in the prior art. Concomitantly, openings that are as few and small as practicable also improve the acoustic environment of the space surrounding the microphone within the chamber.

Another advantage of the new ergonomic performance chamber is to provide an acoustically controlled air space that can be altered or enhanced with a variety of removable acoustic surfaces. These modifiable, replaceable and/or changeable surfaces are each designed with different and/or varied acoustic properties thereby changing the acoustic quality of the acoustically controlled air space when inserted, repositioned, or removed, thus offering more control of the sound reaching the microphone.

Another advantage of the new ergonomic performance chamber is to provide openings, referred to as audio ports, from the outer surface through to the acoustically controlled air space that are openable, adjustable, and fully closable. In performance situations where ambient noise is not a primary concern, these ports may be opened and adjusted to further modify the acoustically controlled air space.

Another advantage of the new ergonomic performance chamber is to provide a range of ergonomically important features designed to significantly improve use, operation, and interaction with other equipment and colleagues thereby increasing efficiency, comfort, and safety.

Another ergonomic advantage of the ergonomic performance chamber is it is much smaller than analogous devices evidenced in the prior art.

Another ergonomic advantage of the ergonomic performance chamber is it is manufactured from lightweight materials.

Another ergonomic advantage of the ergonomic performance chamber is it is much quicker to set up, relocate, take down and/or put away than analogous devices evidenced in the prior art, thus there is less interruption to production time.

Another ergonomic advantage of the ergonomic performance chamber is it offers a quick and easy method of attachment or removal, so it can be readily utilized or removed as production workflow may require.

Another ergonomic advantage of the ergonomic performance chamber is it may be easily positioned and repositioned in tandem with the microphone allowing a wide range of easily adjustable positions, thereby increasing efficiency and reducing performer fatigue.

Another ergonomic advantage of the ergonomic performance chamber is its small size vastly reduces encroachment on limited room or studio space, both physically or visually, thus allowing more room for other equipment, more space for comfort, and relative ease of transport and storage. It also has a much smaller footprint than the prior art which allows the present invention to be conveniently situated adjacent to computers, or otherwise used on most desktops.

Another ergonomic advantage of the ergonomic performance chamber is that the small size and weight also vastly reduces the risk of any injury caused by lifting, transporting, storing or installing the device.

Another ergonomic advantage of the ergonomic performance chamber is the performer can assume a normal or expressive posture, alter positions, and shift weight without being encumbered or restricted by the apparatus. This advantage enhances breath control of the performer, artistic expression, and reduces fatigue during the performance, thus reducing errors and increasing efficiency.

Another ergonomic advantage of the ergonomic performance chamber is that performers can remain in visual contact with colleagues or other performers in a natural and convenient manner, which facilitates important visual communication and cues.

Another ergonomic advantage of the ergonomic performance chamber is the physical distance from the audio source opening to the microphone encourages the proper performer-to-microphone distance, thus reducing proximity effect, pop and sibilance.

Another ergonomic advantage of the ergonomic performance chamber is while recording with guitars, woodwinds, and other instruments or devices, it may be easily positioned and repositioned in tandem with the microphone to suit the performer's preferences, thus greatly reducing physical and visual encumbrance to the musician.

Another ergonomic advantage of the ergonomic performance chamber is its small size and ease of adjustment allows easier placement of the performer's script, music, or other equipment in a convenient and natural position.

An additional advantage of the ergonomic performance chamber is when using two or more microphones in the same room, and placing one basic embodiment of the invention on each of the microphones, microphone bleed is reduced between the respective audio input signals. This enables clearer separation of vocals, or other sound sources, during a performance thus facilitating or reducing editing time.

Another advantage of the ergonomic performance chamber is that musicians can reduce unwanted peripheral noise or sounds while using their instruments. For example, an acoustic guitarist may position the basic embodiment (with microphone on a microphone stand) in front of the guitar's resonating chamber thus reducing unwanted fret noise.

Another advantage of the ergonomic performance chamber is to provide protection for the microphone, particularly when on a microphone stand, from damage in the event of accidental bumps or falls.

Another advantage when using the new ergonomic performance chamber is that the microphone input signal has improved channel separation, which provides an increase of clarity and quality of the audio source. This increase in audio quality, which may be described as an improvement in color, grain, tone, and/or inflection, generally reduces editing time.

Another advantage when using the ergonomic performance chamber is derived from generally improved channel separation, reduced noise, and improved acoustics of the audio source. Improvements include lower send levels for digital sound processors, greater gain before feedback, a stronger audio signal which allows for lower trim, and improved signal to noise ratios. Click noise from headsets is also reduced.

Another advantage of the ergonomic performance chamber is it may be manufactured at lower cost with regard to both materials and labor relative to existing analogous devices. Accordingly, it is likely to be sold at a lower relative price to the consuming public, thereby providing all the advantages herein to a larger number of people.

Another advantage of the ergonomic performance chamber is its durability, reliable construction, efficiency of manufacturing, and low cost of shipping.

Another advantage of the new ergonomic performance chamber is it provides a compelling range and combination of advantages, features, and attributes unsolved by analogous devices in the prior art. The interaction and combination of all of the advantages, features, and attributes collectively and synergistically contribute to increased production efficiencies and performer comfort, and answer an unfulfilled need in the marketplace.

Another advantage of the ergonomic performance chamber is to provide in the apparatuses and methods of the prior art some of the advantages thereof, while simultaneously overcoming some of the disadvantages normally associated therewith, and collectively incorporated in a new and compelling device.

There has thus been outlined, rather broadly, the more important features of the ergonomic performance chamber in order that the detailed description thereof that follows may be better understood, and in order that the present contribution to the pertinent art may be better appreciated. There are, of course, additional features of the invention that will be described hereinafter and which will form the subject matter of the claims appended hereto.

In this respect, before explaining the basic embodiment of the invention in detail, it is to be understood that the invention is not limited in its application to the details of construction and to the arrangements of the components set forth in the following description or illustrated in the drawings. The invention is capable of other embodiments, and of being practiced and carried out in various ways. Also, it is to be understood that the phraseology and terminology employed herein are for the purpose of description and should not be regarded as limiting.

As such, those of ordinary skill in the pertinent art will appreciate that the conception, upon which this disclosure is based, may readily be utilized as a basis for the designing of other structures, methods, and systems for carrying out the several purposes of the present invention. It is important, therefore, that the claims be regarded as comprising such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

SUMMARY OF THE INVENTION

Existing portative, anechoic chambers that reflect ambient noise and reduce reverberation within the chamber while recording or performing with a microphone have many disadvantages, particularly in view of the advancements and prevalence of audio gear over the last decade. The present invention provides a number of solutions and/or advantages that enhance audio production efficiencies, improve on the foregoing disadvantages of the prior art, and have not been previously anticipated, rendered obvious, suggested, or even implied.

The present invention is much smaller and lighter than evidenced in the prior art and designed to surround only the microphone on all sides, and does not enclose other recording equipment, computer equipment, and either all or part of the performer's body. The outer surface reflects ambient noise, and the inner chamber surface forms a small acoustic room around the microphone, thereby influencing the tonal quality of the sound received by the microphone. Further, the sound reaching the microphone may be modified within the interior acoustically controlled air space using a variety of removable, interchangeable, positionable, acoustic inserts, each designed with different acoustic properties.

Ergonomic considerations such as size, shape, weight, and materials are evidenced in the design and construction of the basic embodiment, and facilitate performer interaction with equipment and colleagues to improve workflow and reduce errors. The basic embodiment solves many shortcomings of the prior art including, quick and easy installation, ease of repositioning, convenience of transporting, naturalness of the performer's posture, improved performer breath control, significantly improved visual communication, improved flexibility for room placement, as well as a small footprint to allow for convenient desktop use. The present invention can also be manufactured cost effectively to meet an existing and growing need for a wide variety of situations and performers, particularly when recording in less than optimal facilities.

BRIEF DESCRIPTION OF THE DRAWINGS

The invention will be better understood and additional advantages other than those set forth above will become apparent when consideration is given to the following detailed description thereof. Such description makes reference to the annexed drawings wherein:

FIG. 11 is a perspective view from the right side of alternative embodiment 1, of the ergonomic performance chamber, partially cut away to show the opened, hard plastic outer shell and the removable inner chamber, relative to the position of the microphone and shock mount.

FIGS. 12A-12C are detail views of an assembly comprising the audio ports, port adjuster, and port panel relative to the outer shell.

Figure 1:
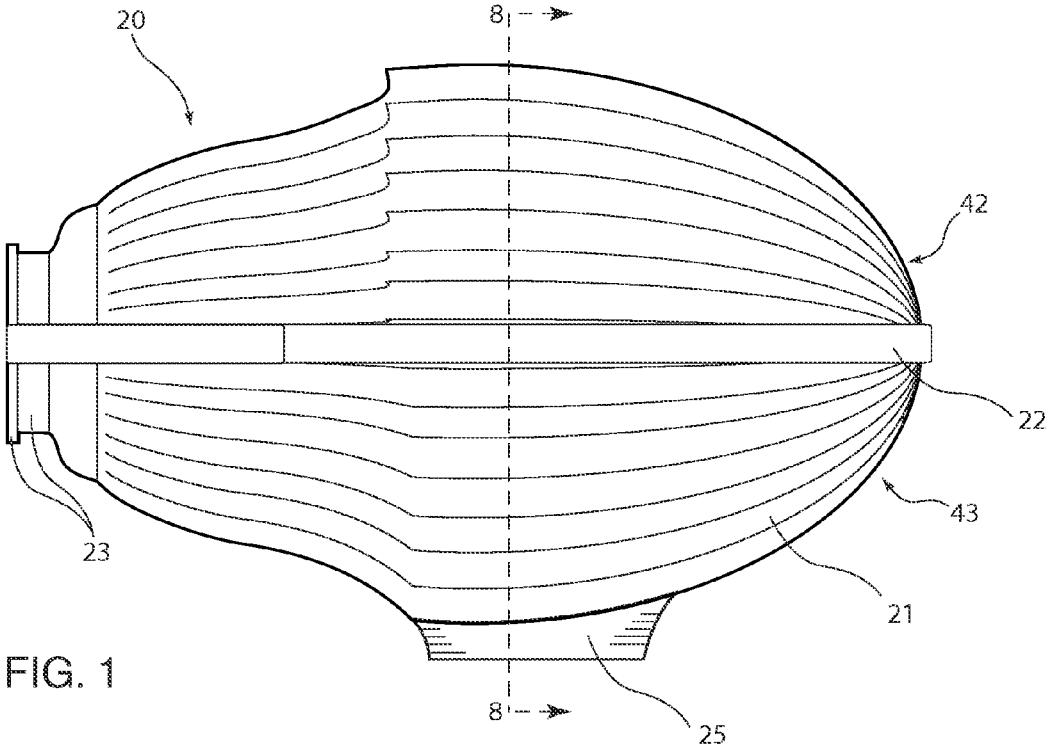
FIG. 1 is a left view of the basic embodiment of the ergonomic performance chamber.

DRAWING REFERENCE NUMERALS 20. elemental structure
21. outer surface
22. abutting surfaces
23. audio source opening collar
24. audio source opening
25. microphone attachment collar
26. microphone opening
27. acoustically controlled air space
28. inner chamber surface
29. chamber body
30. acoustic inserts
31. acoustic insert slots
32. alternative microphone opening
33. audio ports
34. port adjuster
35. removable acoustic chamber
36. microphone
37. shock mount
38. performer
39. desktop support
40. pop screen
41. detent
42. top
43. bottom
44. microphone plug
45. small diaphragm microphone
46. microphone support
47. outer shell
48. port panel
50. ergonomic performance chamber
51. first alternative embodiment
52. second alternative embodiment

DESCRIPTION OF BASIC EMBODIMENT

With reference now to the drawings, and in particular to FIGS. 1-16 thereof, a new ergonomic performance chamber embodying the principles and concepts of the present invention and generally designated by the reference numeral 50 will be described.

The basic embodiment may be manufactured by reaction injection molding. This process involves two reactive liquid components—such as a polyol and an isocyante—that are metered, blended together, and injected into a closed mold at low pressure. The chemical reaction between the two components forms a three to five pound, polyurethane, medium density, flexible foam with an integral skin. The skin thickness may be controlled by material temperature, mold temperature, and the loading of the mold.

Figure 7:
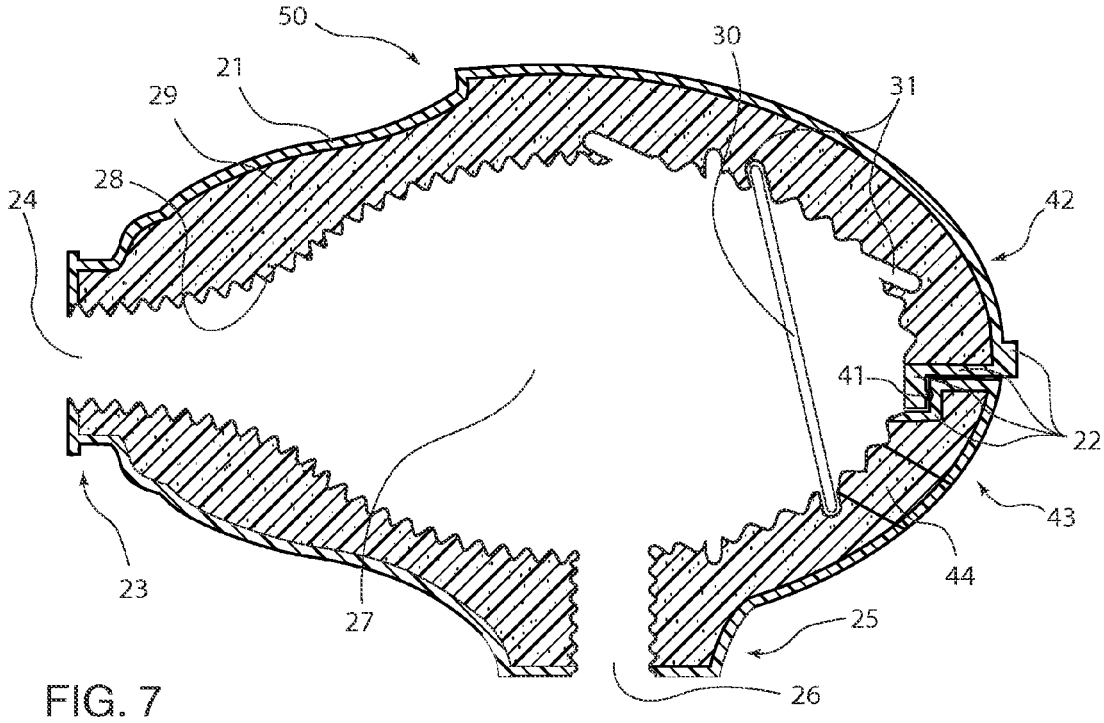
FIG. 7 is a cross sectional view taken along line 7-7 of FIG. 2 of the basic embodiment of the ergonomic performance chamber.
Figure 8:
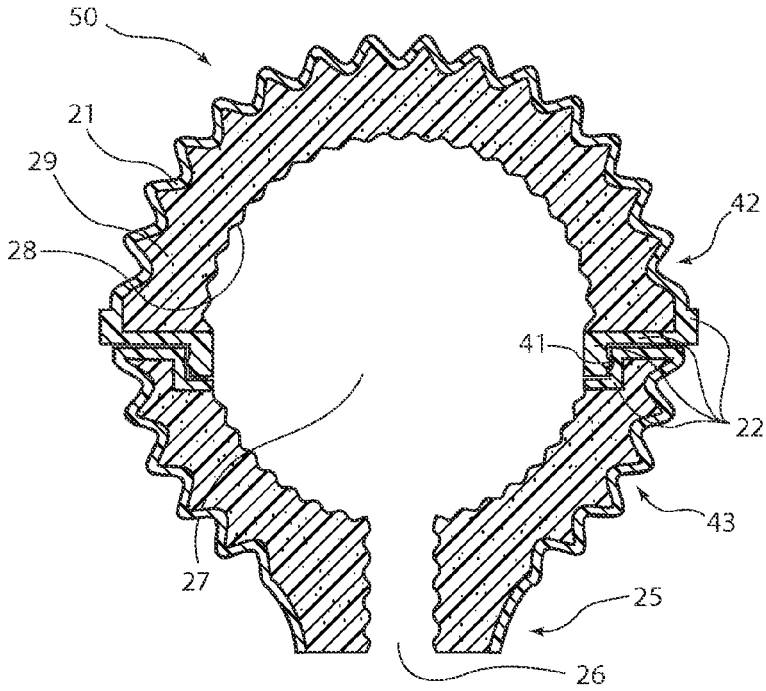
FIG. 8 is a cross sectional view of the basic embodiment taken along line 8-8 of FIG. 1.
Figure 10:
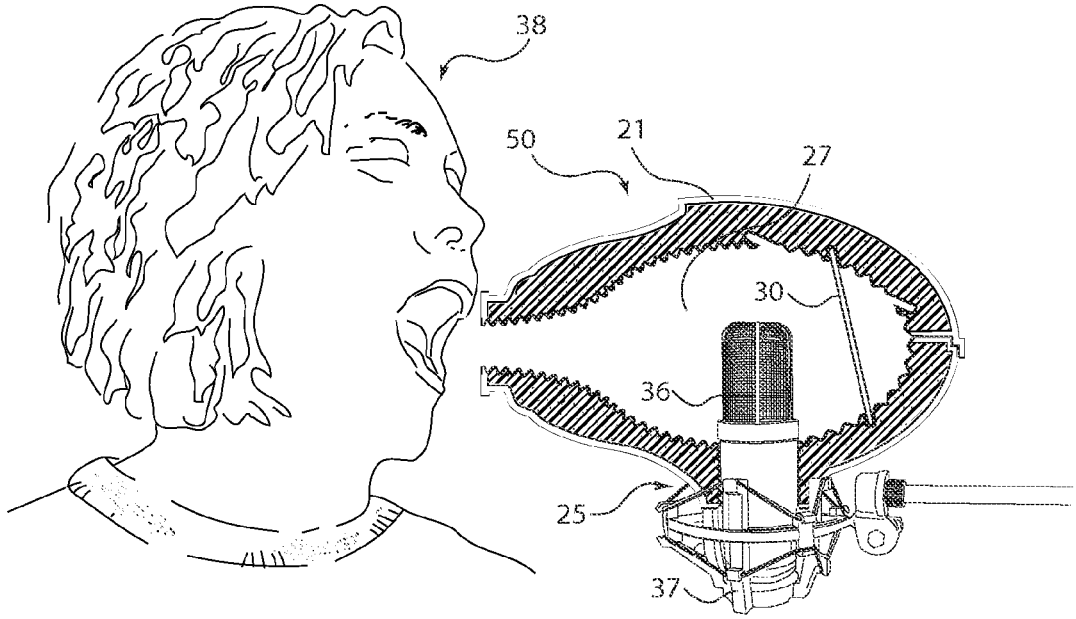
FIG. 10 is a cross section along line 7-7 of FIG. 2 showing the ergonomic performance chamber with performer, microphone, and shock mount.
Figure 13:
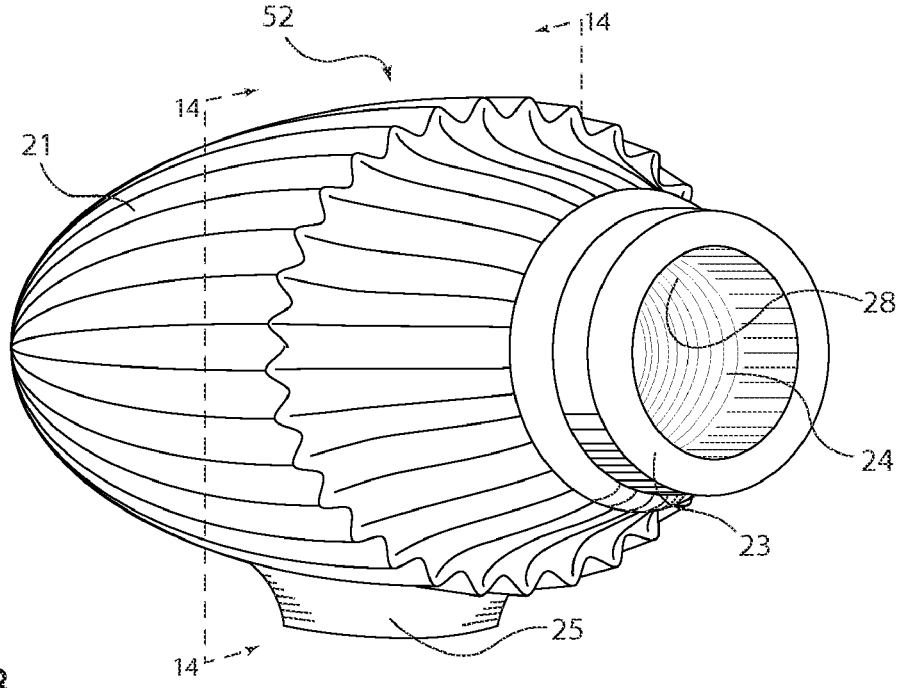
FIG. 13 is a perspective view from the right side, of alternative embodiment 2, of the ergonomic performance chamber.
Figure 14:
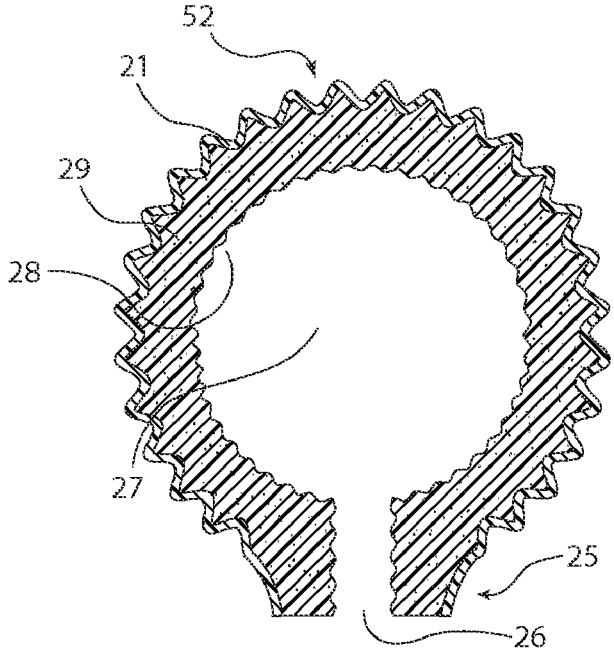
FIG. 14 is a cross sectional view of alternative embodiment 2 taken along line 14-14 of FIG. 13.

The basic embodiment is molded in two parts, generally a top 42 portion and a bottom 43 portion. The top 42 portion and the bottom 43 portion, when positioned correctly relative to each other, may be connected by their respective flexible abutting surfaces 22. The abutting surfaces 22 are integrally molded with a chamber body 29, an outer surface 21, and other elements of the basic embodiment. Further, when positioned correctly relative to each other, the abutting surfaces 22 overlap, interlock, and form a frictionally secure connection aided by virtue of the close tolerance fit, the elasticity of the material, and a small molded detent 41 as illustrated in FIGS. 7 and 8. In FIGS. 7, 8 and 10, a very slight space between the abutting surfaces 22 may be discernable in the illustrations to visually demarcate the top 42 and bottom 43 portions, but it is not intended to suggest there is an actual slight space when the two portions are physically connected.

The injection molding process forms the top 42 and bottom 43 portions, and most of the elements, of the basic embodiment, and may be collectively referred to herein as an elemental structure 20. Thus, the elemental structure 20 is comprised of the top 42 and bottom 43 portions, the outer surface 21, the abutting surfaces 22, an audio source opening collar 23, an audio source opening 24, a microphone attachment collar 25, a microphone opening 26, an interior space called an acoustically controlled air space 27, an inner chamber surface 28, the chamber body 29, and a plurality of insert slots 31 as illustrated in FIGS. 8 and 9.

The elemental structure 20 is made of molded flexible plastic, and is openable, lightweight, and easily portative. Further, the elemental structure 20 of the basic embodiment is constructed to be small in overall size (relative to the prior art) so that it generally surrounds only the microphone 36. Other recording equipment, computer equipment, musical instruments, and the performer 38 are exterior to the elemental structure 20 as illustrated in FIG. 10.

Figure 9:
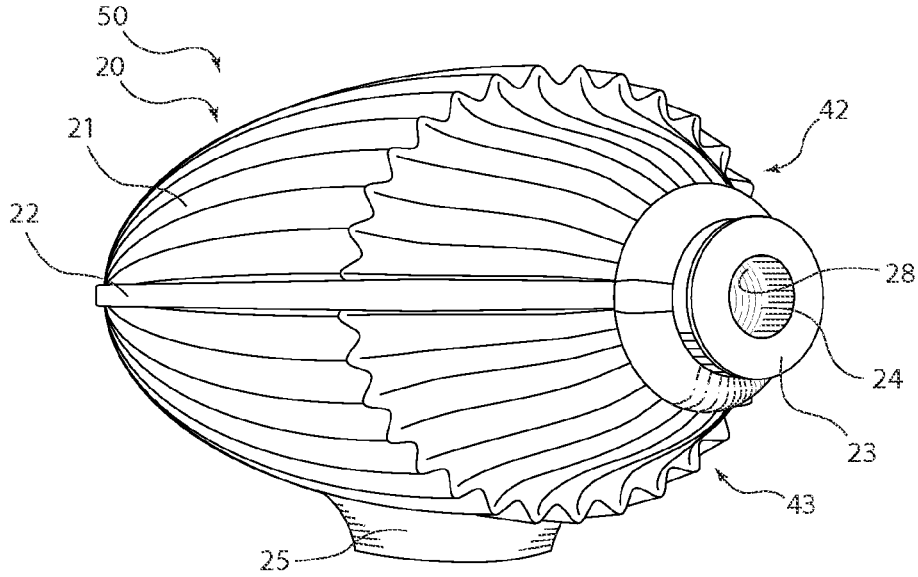
FIG. 9 is a perspective view, from the right side, of the basic embodiment of the ergonomic performance chamber.

The appearance of the basic embodiment is somewhat ovaloid, but actually has a complex overall geometric shape as illustrated in FIG. 9. It has been noted that constructions in other geometrical forms, or in complex organic shapes, have some effect on the character of acoustic quality. In that a particular exterior or interior geometry inevitably offers some variance in acoustic or aesthetic properties, it would be readily understood by those skilled in the pertinent art that such variations of geometry and shape are within the spirit and scope of the basic embodiment.

The outer surface 21 is a closed cell, flexible plastic skin for reflecting ambient noise. The ridge and groove patterned outer surface 21 is integrally molded with the chamber body 29 as illustrated in FIG. 9. The outer surface 21 ridge and groove patterned design contributes a degree of structural integrity to the elemental structure 20, as well as an aesthetic sense to the form.

The chamber body 29, is constructed of molded flexible plastic and constitutes the majority of the mass that forms the elemental structure 20 as illustrated in FIG. 7. The integral, exterior surface of the chamber body 29 is the outer surface 21 of the elemental structure 20, and the integral, interior surface is the inner chamber surface 28 of the elemental structure 20. The chamber body 29 is of a thickness that is predeterminately sized for the best balance of acoustic effectiveness and manufacturing efficiency, and varies approximately from one-half inch, to one and one-half inches of thickness in the basic embodiment. The chamber body 29 is for reducing ambient noise and reverberation.

The ridge and groove patterned inner chamber surface 28, has a varied, sound absorptive, acoustic texture, integrally molded with the chamber body 29 for augmenting chamber body acoustics to further reduce reverberation. Further, the inner chamber surface 28 has insert slots 31 specifically molded to accept and position the removable, changeable, acoustic inserts 30, as illustrated in FIG. 7.

The abutting surfaces 22 are the molded periphery that forms a connecting brim for the top 42 portion and the bottom 43 portion of the basic embodiment, as illustrated in FIG. 8. The respective surfaces of each brim are manufactured of flexible molded plastic, to precise tolerances, and the elastic properties of the material and friction keep the top 42 portion and the bottom 43 portion of the basic embodiment joined during normal operation. Further, the respective surfaces of each brim are so formed to allow overlapping and interlocking between the mutual abutting surfaces 22 of the top 42 portion and the bottom 43 portion when properly aligned, aided by a small detent 41 as shown in FIGS. 7 and 8. The abutting surfaces 22 are for removably joining the top 42 portion and the bottom 43 portion of the elemental structure.

Figure 2:
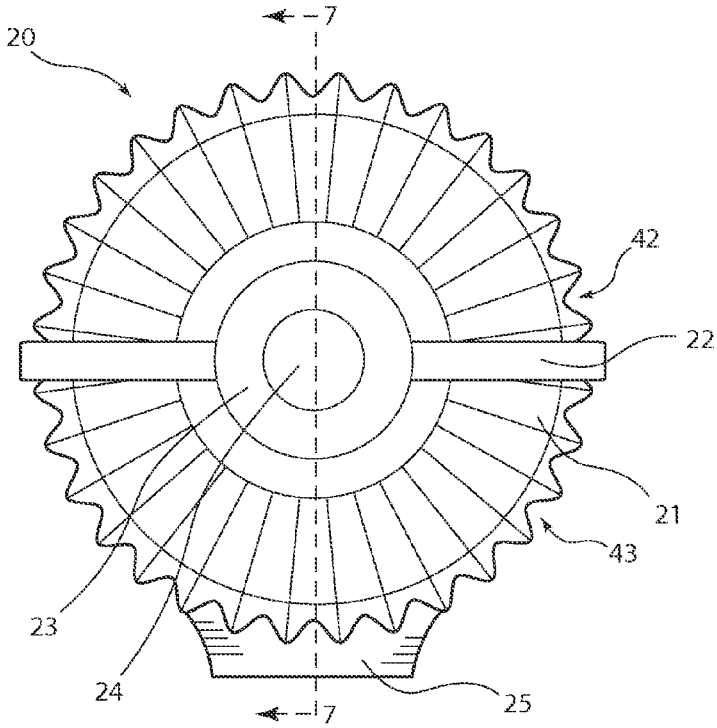
FIG. 2 is a front view of the basic embodiment of the ergonomic performance chamber.
Figure 3:
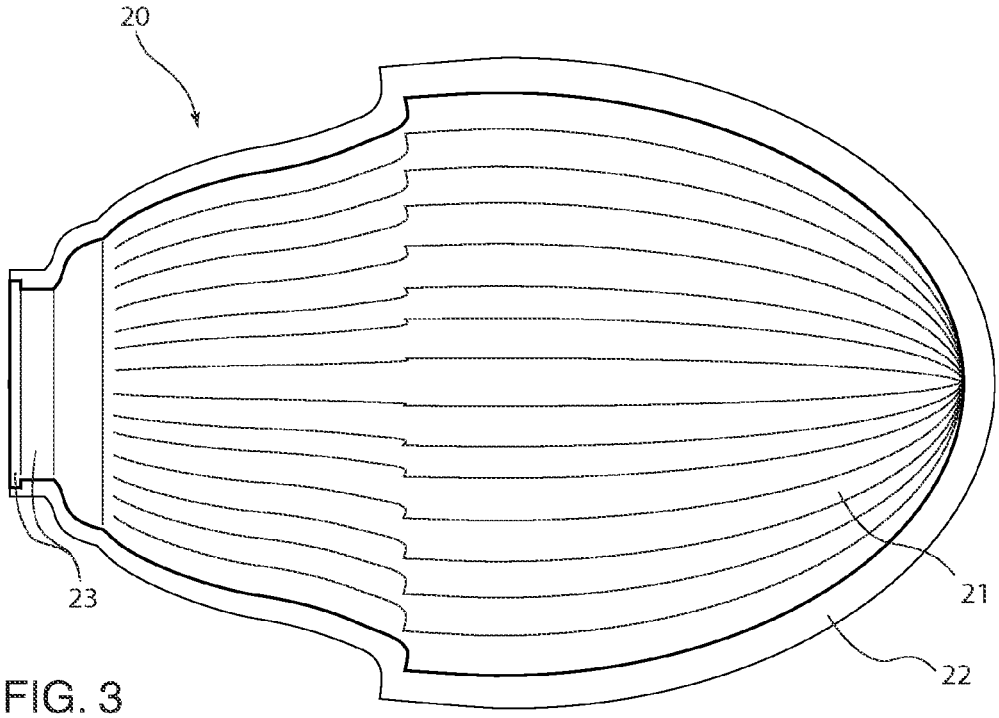
FIG. 3 is a top view of the basic embodiment of the ergonomic performance chamber.
Figure 4:
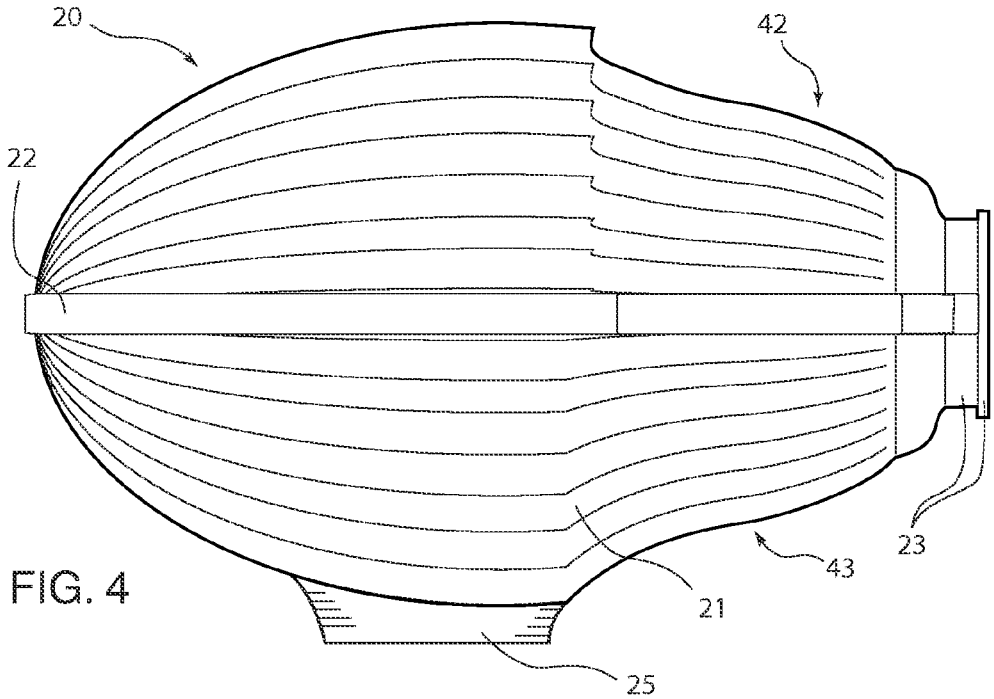
FIG. 4 is a right view of the basic embodiment of the ergonomic performance chamber.
Figure 16A:
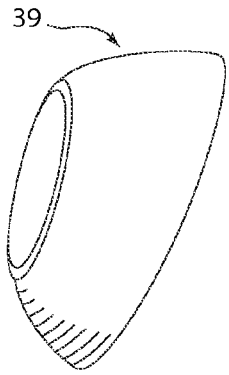
FIG. 16A-FIG. 16G illustrates the desktop support, the accessory pop screen, the ergonomic performance chamber positioned on the desktop support, and a cross section along line 7-7 of the basic embodiment, shown with the microphone, an acoustic insert, accessory pop screen, and the removed microphone plug.
Figure 16B:
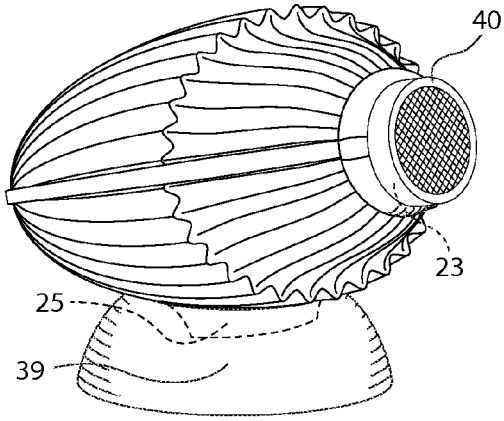
Figure 16C:
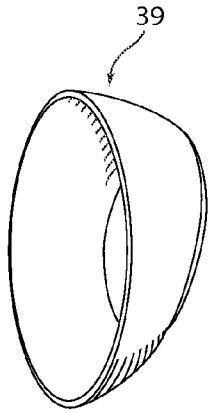

The audio source opening collar 23 is comprised of molded flexible plastic and located on the front surface of the basic embodiment as illustrated in FIG. 2. It is molded to surround and demarcate the audio source opening 24, as illustrated in FIGS. 7 and 9. The audio source opening collar 23 is for accepting accessory components and designed to hold a pop screen 40 directly to the audio source opening collar 23 exterior surface, as illustrated in FIGS. 16B and 16G. Alternatively, a conventional pop screen may be attached to the microphone stand and properly positioned using the customary apparatus. The audio source opening 24 has a diameter that is as small as practicable, and provides a continuous opening through to the acoustically controlled air space 27 for allowing audio source input, as illustrated in FIG. 7.

Figure 6:
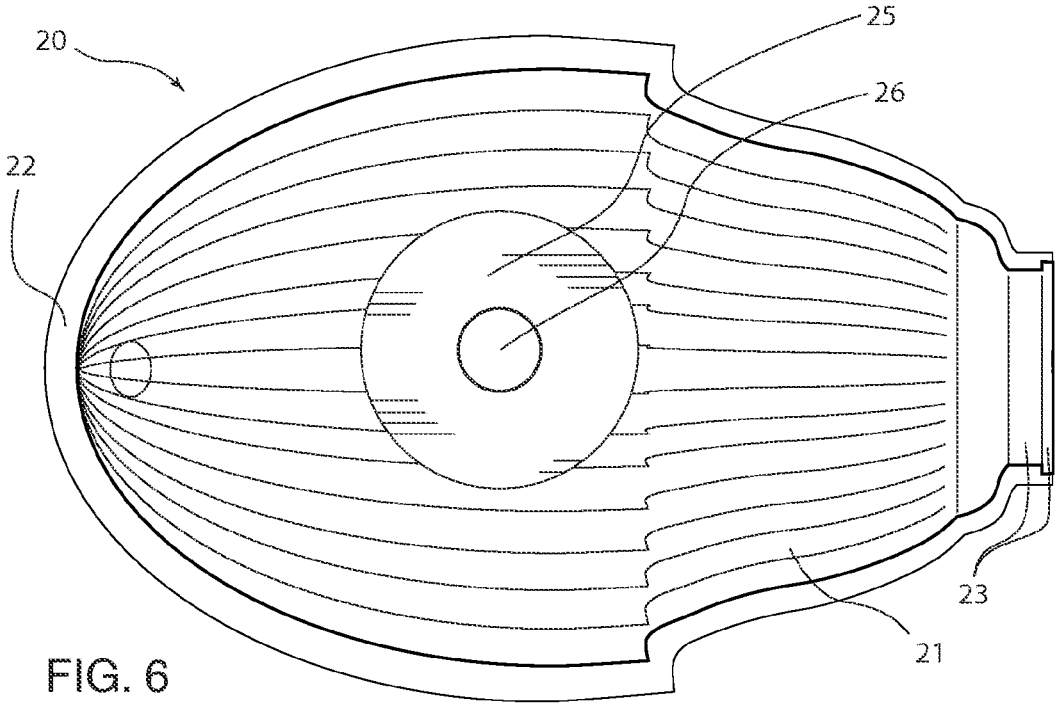
FIG. 6 is a bottom view of the basic embodiment of the ergonomic performance chamber.

Centrally located (approximately) on the underside of the bottom 43 portion of the outer surface 21, as illustrated in FIG. 6, is the microphone attachment collar 25, which surrounds and demarcates the microphone opening 26 as illustrated in FIGS. 6, 7, and 8. The microphone attachment collar 25 is for removably attaching the ergonomic performance chamber to the microphone 36, and is comprised of flexible plastic material that is elastically adjustable. The inner chamber surface 28 and chamber body 29, because they are integrally molded with the microphone attachment collar 25, also help hold the basic embodiment to the microphone 36, shock mount 37, and/or microphone stand, by virtue of the elastic memory of the flexible plastic material and friction, as illustrated in FIG. 10.

The microphone opening 26 is small as practicable, and has an approximate diameter of one inch to three inches in the basic embodiment. The microphone opening 26 provides a continuous opening through to, and merges with, the acoustically controlled air space 27, constructed to allow insertion of the microphone 36, and elastically connect to the microphone 36 housing when the microphone 36 is in place, as illustrated in FIG. 7.

The acoustically controlled air space 27 is the interior space generally surrounded and demarcated by the inner chamber surface 28, and is for receiving acoustic energy. The acoustically controlled air space 27 is predeterminately sized for the best combination of acoustic performance, materials, and manufacturing efficiency, and is constructed to have a volume of approximately 125 cubic inches in the basic embodiment. Acoustic energy is received through the audio source opening 24, which is open through to, and merges with, the acoustically controlled air space 27. Also, the microphone opening 26 is open through to, and merges with, the acoustically controlled air space 27, as illustrated in FIG. 7. Further, the acoustically controlled air space 27, may be physically modified to alter the acoustic energy reflected or absorbed, thus changing the quality of the sound reaching the microphone 36.

Acoustic insert slots 31 are molded into the inner chamber surface 28, and manufactured from the same molded flexible plastic. The acoustic insert slots 31 are predeterminately sized to receive and frictionally secure the placeable acoustic inserts in position as illustrated in FIG. 7.

Figure 15A:
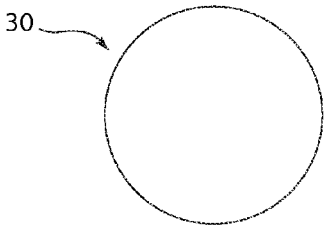
FIG. 15A-FIG. 15O illustrate three views each of five different removable, placeable, acoustic inserts.
Figure 15B:
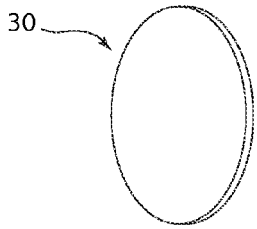
Figure 15C:
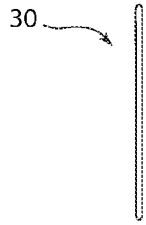
Figure 15D:
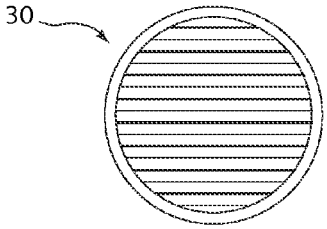
Figure 15E:
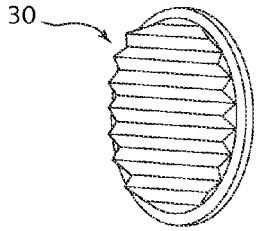
Figure 15F:
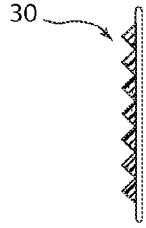
Figure 15G:
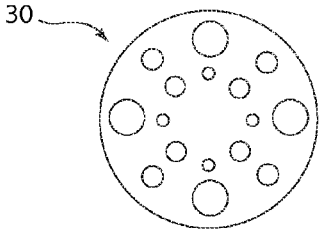
Figure 15H:
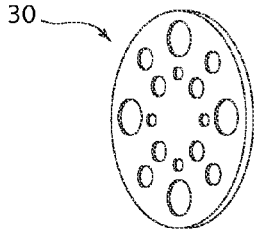
Figure 15I:
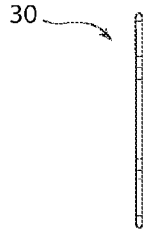
Figure 15J:
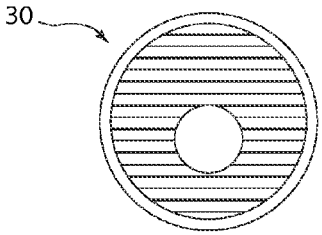
Figure 15K:
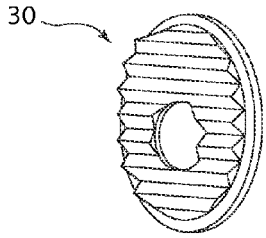
Figure 15L:
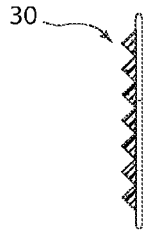
Figure 15M:
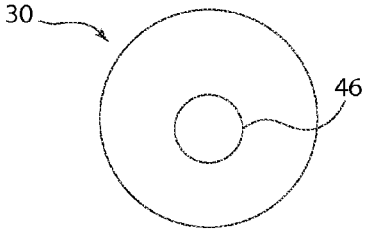
Figure 15N:
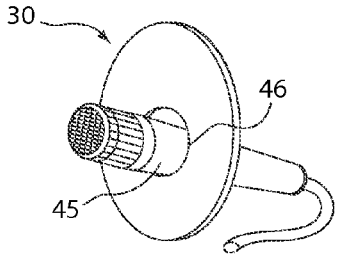
Figure 15O:
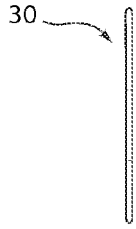

The acoustic inserts 30 are a group of similarly sized panels, which may be positioned and held within the acoustic insert slots 31, for modifying the quality of sound within the acoustically controlled air space 27 of the basic embodiment. Each of the acoustic inserts 30 is intended to reflect or absorb sound differently, and may be manufactured from a combination of methods and materials to suit a particular acoustic effect. In the basic embodiment, the acoustic inserts 30 are generally comprised of a common plastic, approximately ⅛" thick, called acrylonitrile-butadiene-styrene (ABS). Since the acoustic inserts 30 are intended to vary in acoustic properties they may have, for example, a solid surface, a surface with holes, and/or a surface with acoustic foam attached, as illustrated in FIGS. 15A-15O. Further, the acoustic inserts 30 are placeable, positionable, and removable within the acoustically controlled air space 27, thus providing a range of acoustic control.

Operation of Basic Embodiment

The basic embodiment of the ergonomic performance chamber 50 is designed and constructed to be easily and readily installed, operated, and transported in the course of normal production workflow, and solves many of the shortcomings of the prior art.

The basic embodiment is positioned over the microphone 36, aligning the microphone opening 26 with the top of the microphone 36, and gently sliding the basic embodiment downwards, over the microphone 36 housing, allowing the molded flexible plastic of the microphone attachment collar 25 to elastically expand around the microphone 36 housing. The molded flexible material of the microphone attachment collar 25, as well as molded flexible material of the chamber body 29, expands to accept the microphone 36, and the resilient properties of the molded flexible material hold it in place. When best possible placement is achieved, gently rotate the basic embodiment on an axis perpendicular to the vertical aspect of the microphone 36 housing, aligning the audio source opening 24 with the pick-up pattern of the microphone 36 as illustrated in FIG. 10. A shock mount 37, if present, also offers mechanical support under the basic embodiment.

The basic embodiment, once attached to the microphone 36, may now be positioned and repositioned in tandem with the microphone 36, shock mount 37, and boom (if present) on a microphone stand. The basic embodiment thereby requires very little, if any, additional effort to position or reposition, beyond that necessary to position or reposition the microphone 36 in a normal manner, as inferred by the illustration in FIG. 10.

The performer 38 then is free to operate the microphone 36 and related equipment normally, almost as if the basic embodiment was not attached to the microphone 36 housing. The operation of the basic embodiment would be apparent to those skilled in the art and would require little, if any, instruction or training of the performer 38. If the performer 38 is using an instrument, the microphone boom is also easily adjusted to the instrument to suit performer 38 preferences, much as the performer 38 would adjust the microphone 36 position without the basic embodiment attached. The simplicity of operation and the convenience of the basic embodiment over the prior art, including the performer 38 having increased visual communication with others and more freedom of movement, would be readily understood and appreciated by the performer 38 or any person of ordinary skill in the pertinent art.

The basic embodiment is constructed so that the top 42 portion is removably connected to the bottom 43 portion at the abutting surfaces 22 as illustrated in FIGS. 7 and 8. The flexible molded top 42 portion may be gently grasped at or near the abutting surfaces 22 at one end, then with one hand using a lifting motion on the molded top 42 portion, while the other hand stabilizes the molded bottom 43 portion, the abutting surfaces 22 begin to separate. Continuing with the same motion, the abutting surfaces 22 easily disconnect the top 42 portion from the bottom 43 portion and can be entirely separated, and the acoustically controlled air space 27 is now accessible for modification.

Once the two portions are separated, the acoustic inserts 30 may be positioned and placed into the molded acoustic insert slots 31 to modify the quality of sound reaching the microphone 36. The acoustic insert slots 31 are located in multiple locations of the inner chamber surface 28, which allows for a variety of positions for the acoustic inserts 30 relative to the microphone 36. Adding, removing, or repositioning the acoustic inserts 30 modifies the quality of the sound to the microphone 36.

The top 42 portion is reinstalled for normal operation by simply positioning it correctly, relative to the bottom 43 portion, so the audio source opening 24 and other physical features align. The abutting surfaces 22 of both the top 42 portion and bottom 43 portion are then gently pressed together by hand to mate their respective surfaces and interlock the detent 41, thus completing the closure. The basic embodiment is again ready to be used for recording or performances.

The operation of removing the top 42 portion of the basic embodiment, executing the acoustic modifications with acoustic inserts 30, and reinstalling the top 42 portion, may be conveniently accomplished while the basic embodiment is still attached to the microphone 36 housing thus facilitating production workflow.

Figure 5:
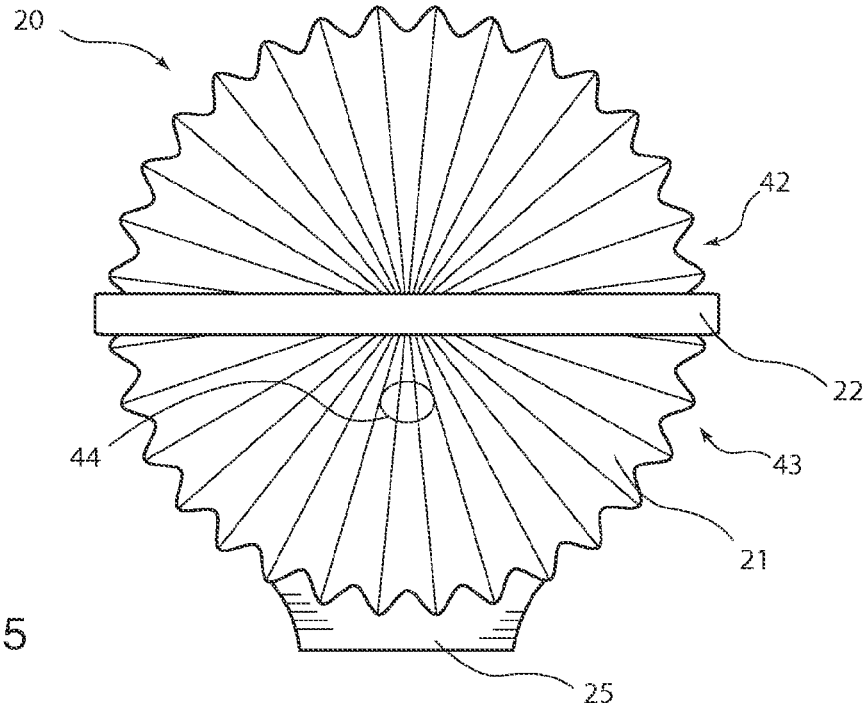
FIG. 5 is a rear view of the basic embodiment of the ergonomic performance chamber.

The basic embodiment may also be conveniently installed for use on a table or desktop by positioning it in the desktop support 39, as illustrated in FIGS. 16B and 16G. An alternative microphone, such as a small diaphragm microphone 45 may be inserted through the alternative microphone opening 32 located on the back side of the bottom 43 portion of the elemental structure 20, as illustrated in FIGS. 5 and 16G.

The alternative microphone opening 32 is manufactured by a circular cut through the outer surface 21, the chamber body 29, and the inner chamber surface 28. The microphone plug 44 is formed from the inner aspect of that circular cut and is generally cylindrical in shape, with the texture and shape of the outer surface 21 on one end, and the texture and shape of the inner chamber surface 28 on the opposing end. The microphone plug 44 is held in place by the elastic nature of the molded flexible plastic and friction. It may be removed by holding the bottom 43 portion of the elemental structure 20 in one hand, and gently pushing it through with the other hand until it is free, as illustrated in FIG. 16G.

One of the acoustic inserts 30, of the type designed for a small diaphragm microphone 45 as illustrated in FIGS. 15J-15O, is placed into the acoustic insert slots 31 of the bottom 43 portion, also as illustrated in FIG. 16G. The small diaphragm microphone 45 is introduced through the flexible plastic of the outer surface 21 and continues into the acoustically controlled air space 27, and then further until the neck of the small diaphragm microphone 45 is resting on the inner edge of the microphone support 46 aperture, of the selected acoustic insert 30. The top 42 portion is reconnected to the bottom 43 portion as previously described, and the assembled structure with enclosed microphone 45 are positioned onto the desktop support 39, as illustrated in FIG. 16B.

The microphone plug 44 is replaceable, and may be reinserted to close the alternative microphone opening 32 once the small diaphragm microphone 45 is removed.

Figure 16D:
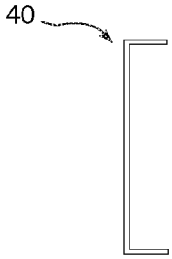
Figure 16E:
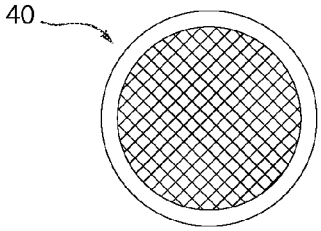
Figure 16F:
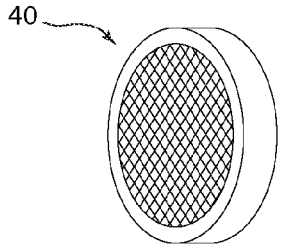
Figure 16G:
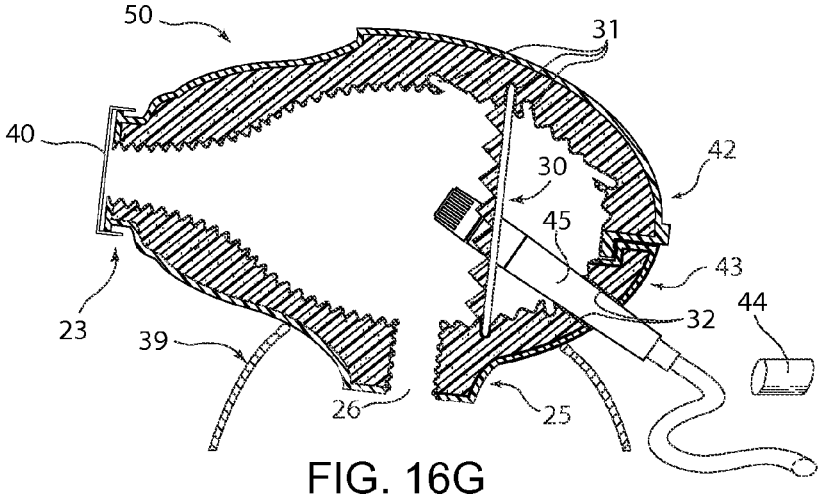

A pop screen 40, as illustrated in FIGS. 16D-16F, manufactured of rigid plastic and nylon fabric, in a conventional manner and to the appropriate physical tolerances, may be directly attached to the audio source opening collar 23, as illustrated in FIGS. 16B and 16G. The inner aspect of the pop screen 40 collar is simply aligned, and gently advanced onto the outer aspect of the audio source opening collar 23, and held in position by virtue of the elasticity of the audio source opening collar 23 and friction. Alternatively, a conventional pop screen may be attached to the microphone stand and properly positioned using the customary apparatus.

Description of a First Alternative Embodiment

A first alternative embodiment 51 provides similar advantages, improvements and construction as the basic embodiment and also varies from the basic embodiment in some ways. The specification should be regarded in its entirety to better understand the concepts and descriptions of both the basic embodiment and the first alternative embodiment. The variations offer certain advantages and disadvantages if compared with the basic embodiment, and are reviewed in the paragraphs that follow.

The first alternative embodiment has an outer shell 47 that is molded from a rigid plastic such as ABS or polypropylene. The outer shell 47 is hinged, openable, and circumferentially encompasses a removable acoustic chamber 32, as illustrated in FIG. 11, and improves reflectivity of ambient noise.

The removable acoustic chamber 35, which is manufactured of molded flexible plastic, and is not integral with the outer shell 47, is constructed to be removable in its entirety, and replaced with a similarly constructed removable acoustic chamber 35 with different acoustic properties. The acoustic properties may differ by inner surface texture, material, and/or shape, to create a distinctive acoustic quality in each removable acoustic chamber 35. Modifiable acoustic properties were previously described in the basic embodiment, and although this construction falls within the same spirit and scope, the first alternative embodiment discloses a physically different approach in materials, operation, manufacturing, and cost.

The first alternative embodiment 51 also provides audio ports 33 or openings that may be adjusted to be closed, fully open, or partially open. There is a rigid plastic port panel 48 constructed so that it has a surface that closely aligns with the inner surface of the outer shell 47. The port panel 48 is rigidly connected through the outer shell 47 to the port adjuster 34 on the exterior surface of the outer shell 47 by a small plastic rod approximately 3/16" in diameter. The port panel 48 would thus move in tandem with the port adjuster 34 along a small slot through the outer shell 47. The small slot is approximately 1" by 7/32", and guides the movement in tandem of both the port adjuster 34 and port panel 48 along a 1" travel path, as well as physically determining the stopping points of that movement. The port panel 48 is predeterminately sized to functionally cover and occlude the audio ports 33 in the outer shell 47 when in the closed position, and mechanically slides forward a predetermined short distance to the open position when the port adjuster 34 is moved by hand in a like direction. Thus, when the audio ports 33 in the port panel 48 align with audio ports 33 in the outer shell 47, the resulting openings then are continuous through from the exterior of the outer shell 47 to the interior beyond the port panel 48, as illustrated in FIGS. 12A-12C. Further, the removable acoustic chamber 35 has analogous openings, of the same approximate size, that align with the audio ports 33 when in the full open position, thus providing a continuous open pathway through to the acoustically controlled air space 27, thereby allowing acoustic energy to be adjustably released.

The first alternative embodiment 51, relative to the basic embodiment, would cost more to manufacture, would weigh more, and be slightly less convenient to handle. However, the improvement in reduction of ambient noise, in those circumstances where ambient noise is a primary concern, is an important consideration. Further, the first alternative embodiment 51 can accommodate more intricately designed modifiable acoustics using removable acoustic chambers 35, perhaps purchased by the consumer only as needed for a particular acoustic effect. The audio ports 33 offer an additional way to modify acoustic energy not found in the basic embodiment. Despite the increase in manufacturing costs, these improvements or advantages are worthwhile considerations for the first alternative embodiment.

Operation of the First Alternative Embodiment

The first alternative embodiment 51 operates similarly to the basic embodiment in many ways, and differs primarily by how the acoustics of the acoustically controlled air space 27 and inner chamber surface 28 are modified. This includes the rigid plastic outer shell 47 that improves ambient noise reflectivity, the removable acoustic chamber 35 to modify interior acoustic textures and properties, and the adjustable audio ports 33 through the outer shell 47 into the acoustically controlled air space 27 that can be adjusted to vary acoustic energy and the quality of sound reaching the microphone.

The upper portion of the rigid plastic, hinged, outer shell 47 is simply and carefully opened to its fullest extent, until the arc of its hinged movement is arrested by the physical presence of the now adjacent lower portion of the outer shell 47, as suggested in FIG. 11. The removable acoustic chamber 35 can be physically removed in its entirety by grasping it gently with one hand, while stabilizing the outer shell 47 with the other, and executing a lifting motion concomitantly with a slight twisting motion, until the elastically attached removable acoustic chamber 35 is separated and free from the microphone 36 and outer shell 47. The same removable acoustic chamber 35, or a similarly constructed removable acoustic chamber 35 with different acoustic properties, may be reinstalled by generally reversing the order previously described.

The audio ports 33 may be adjusted to be closed, fully open, or partially open. In the closed position, the port panel 48 covers the audio ports 33 within the outer shell 47. Using a thumb or index finger, the port adjuster 34 may be mechanically moved forward (towards the audio source opening collar 25) a short distance to the open position. The open position can be visually confirmed as the openings in the port panel 48 align with openings in the outer shell 47, and the openings are now continuously through to the acoustically controlled air space 27. To close the audio ports 33 use a thumb or index finger to mechanically move the port adjuster 34 back (away from the audio source opening collar 25) a short distance to the closed position. Hence, the audio ports 33 are opened, closed, or adjusted simply by moving the port adjuster 34 in one direction or the other.

Description of a Second Alternative Embodiment

A second alternative embodiment 52 provides similar advantages, improvements and construction as the basic embodiment and also varies from the basic embodiment in some ways. The specification should be regarded in its entirety to better understand the concepts and descriptions of both the basic embodiment and the second alternative embodiment. The variations offer certain advantages and disadvantages if compared with the basic embodiment and are reviewed in the paragraphs that follow.

The second alternative embodiment 52 is constructed without a provision for acoustic inserts 30, or the removable acoustic chamber 35, or other features so constructed to conveniently modify acoustic properties. The second alternative embodiment 52 therefore foregoes the advantages described for such modifiable acoustics, and is not openable or accessible to the acoustically controlled air space 27, as described in the basic embodiment. However, the second alternative embodiment 52 still provides all the other advantages of the basic embodiment, and because of the lower manufacturing costs, the consumer is like to benefit from lower costs as well. Thus the second alternative embodiment 52 is considered an important embodiment of the present invention.

Operation of the Second Alternative Embodiment

Operation of the second alternative embodiment 52 is very similar to the basic embodiment, except that there is no provision for the acoustic inserts 30, nor is there access to modify the acoustically controlled air space 27. The operation of the second alternative embodiment 52 would be easily understood by those skilled in the art upon reviewing the operation of the basic embodiment.

CONSIDERATIONS AND RAMIFICATIONS

The present invention referred to herein as an ergonomic performance chamber 50 has been described in three possible constructions, the basic embodiment, the first alternative embodiment 51, and the second alternative embodiment 52. Other variations and/or embodiments incorporating improvements and advantages of the present invention will be apparent to those skilled in the art, some of which are briefly reviewed in the following paragraphs.

Advantages of the ergonomic performance chamber 50 include improved efficiency and operability by surrounding only the microphone 36, an acoustically controlled air space with modifiable inner chamber surfaces, a low cost to manufacture, and a wide range of ergonomic benefits contributing to meaningful production efficiencies. Once the fundamental design, construction, and operation of the ergonomic performance chamber 50 are understood, the improvements and advantages described herein would be clearly apparent. The shortcomings and disadvantages of the prior art that the present invention has improved upon or solved have been overlooked for decades, which attests to the difficulty of recognizing and improving on those shortcomings and disadvantages.

The material or materials chosen in constructing embodiments of the present invention offer a myriad of possibilities. Advantages and improvements such as the degree of sound reflectivity of the outer surface 21 or outer shell 47, the desired acoustic characteristics of the chamber body 29, the acoustic characteristics of the modifiable inner chamber surface 28, and ergonomic features such as weight and method of attachment, are considerations impacted by using different materials and/or different manufacturing processes. The selection of materials used may be prioritized by the ergonomic and/or acoustic advantages emphasized, by the effectiveness of those materials selected, or by the price the consumer is willing to pay for the advantages and improvements those materials impart.

For example, if consumers favored an embodiment that stressed the advantage of sound reflectivity, then increasing the density of the outer surface 21 or outer shell 47 may be one method to provide that advantage. A plastic coating may be added to the outer surface 21, or for a construction with a separately formed outer shell 47, aluminum or a graphite composite material are both possibilities. Consequently, the ergonomic performance chamber 50 would weigh more and be somewhat less convenient to transport, install, and position. Also, a clasp or clamp may be required to securely attach the ergonomic performance chamber 50 to the microphone 36 housing or microphone stand. Manufacturing costs would likely increase, as would the cost to the consumer. Nevertheless, these variations or embodiments may reflect a viable combination of advantages and improvements and should be considered within the spirit and scope of the present invention.

The overall shape of the ergonomic performance chamber 50 has some bearing on how the quality of sound is acoustically influenced within the acoustically controlled air space 27, and to a lesser degree how well it reflects ambient noise. There are many variations of shapes that can affect the quality of sound. The difference in audible quality between shapes, such as a sphere, an ellipsoid, or a cube, is somewhat subjective and to a degree, a matter of personal preference. For example, there are some exotic organic shapes that may offer interesting interior chamber acoustics, but the increased cost to manufacture these shapes may present a disadvantage to the consumer at this time. The acoustically controlled air space 27 and modifiable inner chamber surface 28 provides a construction and method to adjust acoustics to suit personal preference, thus minimizing the limitations of a static overall shape. Still, it can not be dismissed that such complex or intricate designs may offer real world improvements well worth the increase in manufacturing costs, and fall within the spirit and scope of the present invention.

Further, the elements of the present invention described herein may be connected or associated with other parts of the present invention in a different way. For example, openings could be associated with alternative surfaces such as the back, front or top, or have a different orientation. For example, the opening for the microphone 36 could be through the top 42 portion, rather than the bottom 43 portion, to accommodate the microphone 36 when suspended from above. Alternatively, it may be necessary to have an opening from the right side or left side surface for constructing an embodiment that would be more effective for attaching to a video camera or other device. Another possibility is the acoustic inserts 30 may be positioned differently than depicted within the acoustically controlled air space 27, or another construction could mechanically secure the acoustic inserts 30 in another way. The acoustic inserts 30 may even be secured without a particular mechanical connection, relying on simple friction and the elastic properties of the materials to wedge-fit the acoustic inserts 30 to the inner chamber surface 28, and still offer reasonably secure attachment for this purpose.

Another method to attach the present invention to the microphone 36 housing or microphone stand would be to use a built-in screw clamp, spring-loaded clamp, or other mechanical attachment device that more securely connects the present invention to the microphone 36 or a stand, rather than rely primarily on the elasticity of the molded flexible material and friction as in the basic embodiment. For desktop use, an adjustable tripod designed to accommodate the ergonomic performance chamber may offer advantages over the molded plastic desktop support 39, and be used effectively for desktop operation, or other production purposes, when a microphone stand is unnecessary or unavailable.

The modifiable acoustics may be implemented in a different manner. For example, the shape of the acoustic inserts 30 may offer curved or otherwise complex surfaces, rather than generally flat surfaces depicted in the basic embodiment. Additionally, they may be made to be reversible, with different acoustic properties on each side. Also, they may be designed to insert through slots that penetrate through the outer surface 21 or outer shell 47, the chamber body 29, and into the acoustically controlled air space 27, somewhat like inserting toast into a toaster slot, without having to open the ergonomic performance chamber 50. Altering the acoustics may be achieved in other ways. A construction with articulated segments, could offer rotatable inner acoustic surfaces that vary when the position of a segment is rotated. These variations or embodiments offer interesting alternatives and advantages that are within the spirit and scope of what is claimed.

Other embodiments may be constructed for specialized purposes. For example, an embodiment shaped to better accommodate the microphone of a video camera and ergonomically designed to address camera-specific considerations. Or a very durable variation, perhaps made of light metals, optimized for harsh environments and utilizing embedded fasteners, mechanical hinges, and/or threaded assemblies as needed. Still another embodiment could incorporate a built-in microphone with cable and/or wireless jacks or ports that would provide the advantages of the present invention in combination with other devices and technology.

Generally, but not exclusively, the combination of three principles guides the possible variations or embodiments of the present invention. They are the acoustic effectiveness of the materials used, ergonomic and production efficiencies emphasized, and the cost to manufacture. Emphasizing any one of these three principles determines, to some degree, the construction of the embodiment that can then be designed and may lessen the quality or effectiveness of one, or both, of the other two mentioned principles.

With respect to the above description then, it is to be realized that the optimum dimensional relationships for the parts of the invention, to include variations in size, materials, shape, form, function and manner of operation, assembly and use, are deemed readily apparent and obvious to any person of ordinary skill in the pertinent art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents that may be resorted to, fall within the scope of the invention.

What is claimed is:

1. An ergonomic performance chamber for reducing ambient noise, reducing reverberation, enhancing acoustic quality, improving production efficiencies, comprising:

an easily portative said ergonomic performance chamber, measuring 18 inches or less in any one dimension;

said ergonomic performance chamber shaped to minimize interference with a performer while recording or performing with a common microphone;

said ergonomic performance chamber does not encompass said performer's head or any part of said performer's body in normal operation;

said ergonomic performance chamber is removably attached to said microphone;

said ergonomic performance chamber is positionable in tandem with said microphone when said microphone is attached to a conventional mic stand or other support or both;

an audio source opening, for allowing audio source input into an acoustically controlled air space;

a microphone opening to removably accommodate said microphone, for allowing insertion of said microphone into said acoustically controlled air space;

said acoustically controlled air space, for receiving acoustic energy, continuously connected to said microphone opening, continuously connected to said audio source opening;

a top portion and a bottom portion, removably connected, allowing said ergonomic performance chamber to be conveniently openable, to facilitate modifications by said performer; a plurality of removable, positionable, placeable acoustic inserts, each constructed to fit within a chamber body, removably attached to said chamber body, said acoustic inserts to enhance or further modify the audio source entering said acoustically controlled air space; and a plurality of acoustic insert slots, said acoustic insert slots penetrate an inner chamber surface and into said chamber body, or are otherwise affixed or molded to said inner chamber surface, said acoustic insert slots constructed for receiving and holding said acoustic inserts in position within said acoustically controlled air space.

2. An ergonomic performance chamber for reducing ambient noise, reducing reverberation, enhancing acoustic quality, improving production efficiencies, comprising:

an easily portative said ergonomic performance chamber, measuring 18 inches or less in any one dimension;

said ergonomic performance chamber shaped to minimize interference with a performer while recording or performing with a common microphone;

said ergonomic performance chamber does not encompass said performer's head or any part of said performer's body in normal operation;

said ergonomic performance chamber is removably attached to said microphone;

said ergonomic performance chamber is positionable in tandem with said microphone when said microphone is attached to a conventional mic stand or other support or both;

an audio source opening, for allowing audio source input into an acoustically controlled air space;

a microphone opening, to removably accommodate said microphone, for allowing insertion of said microphone into said acoustically controlled air space;

said acoustically controlled air space, for receiving acoustic energy, continuously connected to said microphone opening, and continuously connected to said audio source opening; and an alternative microphone opening, to removably accommodate said microphone, continuously connected to said acoustically controlled air space, closable when not in use, said ergonomic performance chamber having at least one said alternative microphone opening or more, whereby said alternative microphone opening allows for effective placement of microphone when said ergonomic performance chamber is positioned on a flat surface rather than attached to a mic stand, or for a different microphone angle relative to the audio source opening, or for use of more than one said microphone in said acoustically controlled air space.

3. An ergonomic performance chamber for reducing ambient noise, reducing reverberation enhancing acoustic quality, improving production efficiencies, comprising:

an easily portative said ergonomic performance chamber, measuring 18 inches or less in any one dimension;

said ergonomic performance chamber shaped to minimize interference with a performer while recording or performing with a common microphone;

said ergonomic performance chamber does not encompass said performer's head or any part of said performer's body in normal operation;

said ergonomic performance chamber is removably attached to said microphone;

said ergonomic performance chamber is positionable in tandem with said microphone when said microphone is attached to a conventional mic stand or other support or both;

a top portion and a bottom portion, removably connected, allowing said ergonomic performance chamber to be conveniently openable, to facilitate acoustic modifications by said performer;

an audio source opening, for allowing audio source input into an acoustically controlled air space;

an adjustable microphone attachment collar, for removably attaching said ergonomic performance chamber to said microphone, easily and quickly, to an elemental structure;

a microphone opening, to removably accommodate said microphone, for allowing insertion of said microphone into said acoustically controlled air space;

a closable alternative microphone opening, to removably accommodate said microphone, continuously connected to said acoustically controlled air space;

said acoustically controlled air space, for receiving acoustic energy, continuously connected to said microphone opening, and continuously connected to said audio source opening, and continuously connected to said alternative microphone opening;

a plurality of removable, positionable, placeable acoustic inserts, each constructed to fit within said ergonomic performance chamber, removably attached to a chamber body having a plurality of acoustic insert slots, said acoustic inserts for modifying the quality of sound in said acoustically controlled air space; and a plurality of said acoustic insert slots, said acoustic insert slots penetrating into said chamber body, or otherwise affixed or molded thereto, for receiving and holding said acoustic inserts in position.

4. The ergonomic performance chamber in accordance with claim 1, further comprising an openable outer shell, for reducing ambient noise, capable of releasably containing a removable inner chamber.

5. The ergonomic performance chamber in accordance with claim 4, further comprising a replaceable, interchangeable, removable inner chamber with particular acoustic properties, for reducing ambient noise, reducing reverberation, and enhancing sound quality, conveniently replaced with another like constructed said removable inner chamber, featuring a different set of particular acoustic properties, each circumferentially encompassing to said acoustically controlled air space.

6. The ergonomic performance chamber in accordance with claim 1, further comprising a desktop support, said desktop support constructed to fit the curvature of the bottom portion of an elemental structure, thus securely supporting said ergonomic performance chamber for normal operation on a flat surface such as a desktop.

7. The ergonomic performance chamber in accordance with claim 1, further comprising a plurality of audio ports, having at least one opening, said opening or openings continuous from an outer surface through to said acoustically controlled air space.

8. The ergonomic performance chamber in accordance with claim 7, further comprising a port panel mechanically connected to a port adjuster.

9. The ergonomic performance chamber in accordance with claim 8, further comprising said port adjuster, mechanically connected to said port panel, thereby allowing said performer to adjust the size of said audio ports openings, for adjusting acoustic energy from an audio source within said acoustically controlled air space, thus allowing further control of acoustic effect and sound quality.

10. The ergonomic performance chamber in accordance with claim 1, further comprising an audio source opening collar, for accepting accessory components such as, but not limited to, wind screens.

* * * * *